United States Patent [19]

Girotti

[11] Patent Number: 5,046,884

[45] Date of Patent: Sep. 10, 1991

[54] ROADWAY TRAFFIC BARRIERS

[76] Inventor: Marino Girotti, 26 Seapark Drive, St. Catharines, Ontario, Canada, L2M 6S6

[21] Appl. No.: 296,956

[22] Filed: Jan. 17, 1989

[51] Int. Cl.[5] ..... E01F 13/00; E01F 15/00

[52] U.S. Cl. ..... 404/6

[58] Field of Search ..... 404/6, 13, 7, 73; 256/1, 13.1

[56] References Cited

U.S. PATENT DOCUMENTS

| | | | |
|---|---|---|---|
| 1,166,664 | 1/1916 | Dargento | 404/7 |
| 1,683,121 | 9/1928 | Baldwin | 404/13 |
| 1,922,462 | 8/1933 | Tranchell | 404/13 |
| 2,794,375 | 6/1957 | DiFalco et al. | 404/7 |
| 3,326,099 | 6/1967 | Cova | 404/13 |
| 3,373,668 | 3/1968 | Moore et al. | 404/7 |
| 3,958,890 | 5/1976 | Ferrari | 404/9 |
| 3,980,279 | 9/1976 | Bofinger | 256/13.1 |
| 4,113,400 | 9/1978 | Smith | 404/6 |
| 4,496,264 | 10/1198 | Casey | 404/6 |
| 4,605,336 | 8/1986 | Slaw, Sr. | 404/6 |
| 4,624,601 | 11/1986 | Quittner | 404/6 |
| 4,661,010 | 4/1987 | Almér | 404/6 |
| 4,666,332 | 5/1987 | Burgett | 404/6 |
| 4,681,302 | 7/1987 | Thompson | 404/6 |
| 4,773,629 | 9/1988 | Yodock | 404/6 |
| 4,844,652 | 7/1989 | Schroughan | 404/7 |

*Primary Examiner*—Ramon S. Britts
*Assistant Examiner*—Nancy P. Connolly
*Attorney, Agent, or Firm*—McConnell and Fox

[57] ABSTRACT

A concrete roadway barrier element incorporates coupling devices at each end to provide for coupling a series of such barrier elements into a continuous barrier. Each element includes a steel device of "T" shaped cross-section at one end and a mating slotted trough at the other end to receive the "T " shaped device of an adjacent member. The troughs and "T" shaped members are locked into the barrier element during the concrete casting process.

7 Claims, 2 Drawing Sheets

ROADWAY TRAFFIC BARRIERS

FIELD OF THE INVENTION

This invention relates to the field of concrete roadway traffic barriers.

PRIOR ART

To provide separation between various lanes of traffic in a highway, it has been known in the past to use prefabricated barriers which may be joined one to the other to produce a continuous barrier. Typical of such barriers is the barrier shown in U.S. Pat. No. 3,326,099. Preferably these precast concrete barriers have a height comparable to the normal size of a tire with a wide supporting base and an upper portion tapering towards the top. The form assists in deflecting any vehicle driven against the barrier back into the traffic lane. It is obviously necessary that the various elements be linked together to avoid misalignment in the case of impact with a vehicle, and to ensure that the barriers stay in the proper location relative to each other, forming a relatively uniform wall. The manner of interlocking the various elements of the barrier has been solved in various ways.

One particular method of interlocking is shown in U.S. Pat. No. 3,980,279. The barrier disclosed in that patent consists of a series of elements. One element is terminated in a number of protruding T-shaped latching members at each end and the associated element is terminated in a series of troughs which receive the T-shaped elements when the two are arranged end to end.

In U.S. Pat. No. 3,326,099, a tension rod is passed through a number of elements linking them together.

Another simpler connector is shown in U.S. Pat. No. 3,958,890, the elements are intercoupled by means of a ring and pin connector similar to a barngate hinge.

Another solution for intercoupling the elements is shown in U.S. Pat. No. 4,113,400 the ends of the components are provided with tongue and groove connectors. One component will be provided with a pair of grooves at each end, while the associated component will be provided with a pair of tongues at each end.

It is not uncommon during use that one of the elements may become damaged due to accident and have to be replaced, or it may be necessary to move the barrier for some reason. It will, therefore, be necessary to interrupt the barrier and in designs, such as those shown in 3,980,279 and 4,113,400, only every other barrier component can be lifted free. It, therefore, appears that in order to replace a component having projecting elements for coupling, such as the tongue 23 shown in U.S. Pat. No. 4,113,400, it is necessary to remove the adjacent component first. The element having tongues at both ends may now be lifted and moved longitudinally away from its associated component into which its tongue projects.

It would be desirable to provide a barrier in which all the components are identical and in which any component can be removed from the string without removing any associated components.

It will also be noted that in U.S. Pat. No. 4,113,400 the problem of installation and damage to the projecting elements requires an impact resistant insert to overcome the danger of chipping and cracking when the barrier components are moved from place to place or used at different locations. No such provision is made in U.S. Pat. No. 3,980,279, and it will be evident that the elements provided for intercoupling adjacent components project out in a manner so that they can readily be damaged during installation.

It would be preferable that whatever element is used for intercoupling two adjacent components, the elements should be sturdy and not easily damaged.

It should be appreciated that the components themselves are extremely heavy and must be handled by a crane and it is frequently difficult to properly align the elements during installation. It would, therefore, be desirable to provide an intercoupling system which is rugged and strong and yet easily aligns itself during installation.

One of the earlier solutions to intercoupling the components was to pour concrete into the joints. It will, however, be evident that this poses many problems, including the fact that it is difficult to disassemble any part of the barrier. It also a difficult to move the barriers. It is frequently necessary, as will be evident, that the barriers not be aligned strictly in a straight line but may follow various curves depending on the road surface being divided. The freedom of alignment provided in U.S. Pat. No. 3,958,890 and in U.S. Pat. No. 3,980,279 brings with its a flimsy construction which is easily damaged and it would be desirable to provide a freedom of alignment which permits non-linear arrangement of the components and yet not expose the intercoupling devices to easy damage.

SUMMARY OF THE INVENTION

The invention provides an interlocking system for a number for roadway traffic barrier components of sturdy form which strongly locks the various components in relation to each other, and yet permits non-linear alignment and which also is designed for easy placement and removal, each component being identical to its associated adjacent component and the intercoupling means being designed to properly vertically align the components during assembly thus making it easier for the workmen to lower the barrier components in place.

These ends are attained by providing a continuous slot in one end of each barrier component which intercouples with a T-shaped continuous member protruding from the end of its associated component, the ends of the T-shaped member being tapered to facilitate their introduction into the associated slot.

Figure 1:
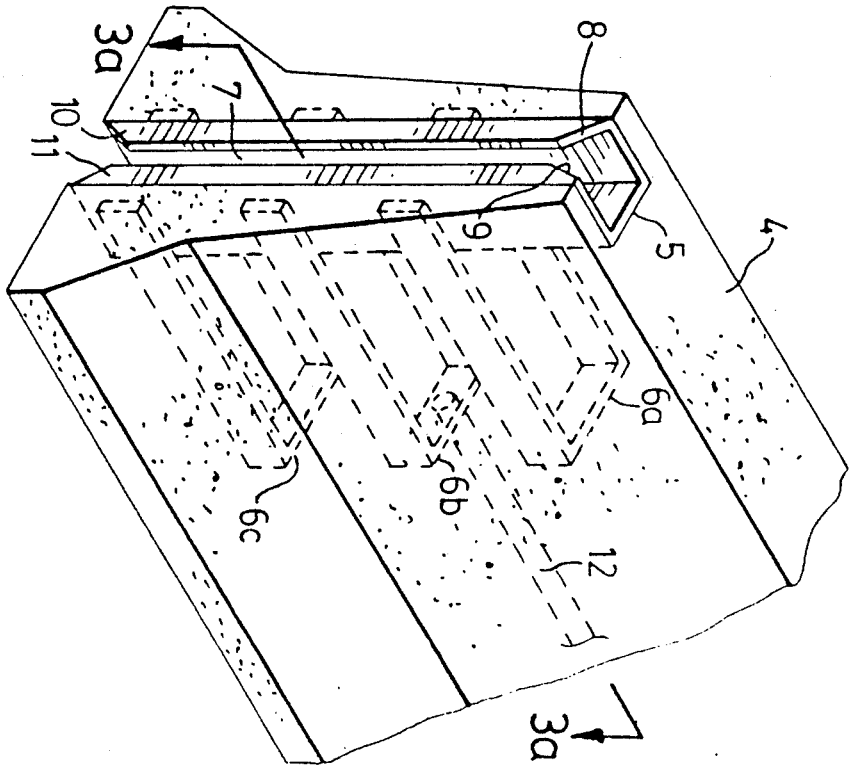
FIG. 1 is an isometric end view of a portion of a barrier in accordance with the invention.
Figures 3A, 3B:
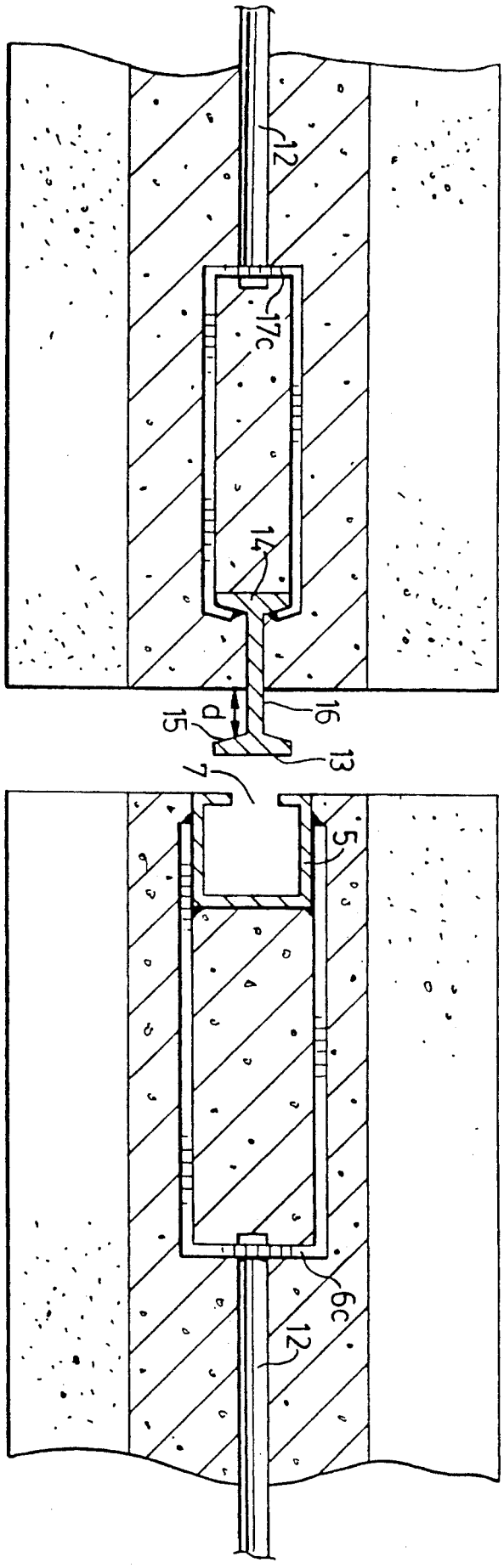
FIG. 3A is a sectional view of the portion shown in FIG. 1 along section plane I—I.
FIG. 3B is a section of the portion shown in FIG. 2 along section plane II—II.

Considering first FIG. 1 and 3A, there is shown a portion of a concrete traffic barrier 4 shaped in the conventional manner to deflect traffic. A trough member 5 is cast into the end of the barrier during the casting process. Stirrups 6*a, b* and *c* are welded to the trough 5 and imbedded in the concrete during the pouring process. The side of the trough which faces outward has a slot designated 7 provided with tapered entrances top and bottom produced by the angle cuts at 8 and 9 in the upper end and 10 and 11 in the lower end of the slot.

One or more rebars such as rebar 12 are hooked onto the stirrups 6 and continue through the whole length of the barrier.

Figure 2:
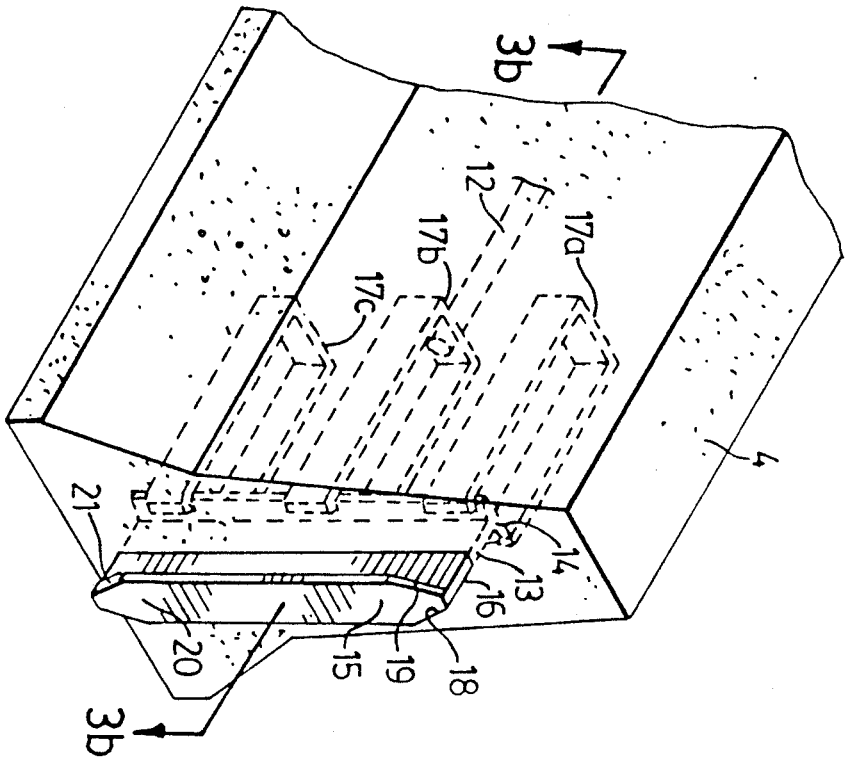
FIG. 2 is an isometric end view of the opposite end of a similar barrier or the same barrier in accordance with the invention.

Turning now to FIGS. 2 and 3B, the opposite end of the same barrier or a similar barrier is shown consisting once more of the precast concrete body 4 and, imbedded in the end of the body, is a section of I-girder 13 with its inner flange 14 imbedded in the concrete and its outer flange 15 protruding from the concrete and held in this position by a web 16 of the I-girder. A plurality of stirrups 17*a, b* and *c* are fastened to the inner flange 14 and imbedded in the concrete during the casting process. The upper and lower portions of flange 15 are tapered as shown by cutting off the corners at 18 and 19 at the upper end and 20 and 21 in the lower end. The rebar 12 is shown hooked onto the stirrup 17*b*.

As shown in section in FIG. 3A, the trough 5 is of essentially rectangular cross-section with a slot 7 in its outer surface, the slot 7 is somewhat wider than the web 16 of I-girder 13.

OPERATION

During installation, the barrier 4 is lifted by means of suitable slings and one end of the barrier is presented to the mating end of the adjacent barrier. If, for example, the end shown in FIG. 1 is on the barrier being lifted, the adjacent barrier will have an end as shown in FIG. 2, or conversely, if the barrier having the end as shown in FIG. 2 is the one being lifted, it will be presented to the end of a barrier such as that shown in FIG. 1. The barrier can now be lowered and the tapered ends of the trough or flange will guide the web of the I-beam correctly into the slot of the trough. The barrier may now be lowered until two portions are completely interlocked. In this manner, a series of barrier components may be joined end to end and the barrier built up as desired.

In the event that the barrier has to be moved or a damaged section removed, the barrier may be lifted by means of suitable slings and any section of the barrier can be lifted since the web 16 of I-beam 13 will pass completely through the slot of channel 5. It does not matter which section is lifted first because the slot is open at both ends and the flange 15 is open at both ends.

The specific width of slot 7 in proportion to the web 16 must be sufficient to permit easy assembly and also to permit some misalignment of the sections so that the barriers may be arranged in non-linear arrangement where, for example, a barrier is progressing around a curve. Similarly, the projection of the flange 15 beyond the surface of the barrier, i.e. the proportion of the web designated "d" in FIG. 3B, will also be determined so that the barriers may be placed completely in touch with each other without the flange 15 striking the back of trough 5 and, at the same time, may be displaced somewhat, so without flange 15 engaging the front of trough 5.

Typical dimensions for the various components might be as follows: the trough 5 can be fabricated by cutting a slot in a standard 4×4 rectangular tube, the slot may be between 1 and 1½ inches wide. Typically, the I-beam would have the dimensions of about a 5 inch web and flanges about 3 inches wide. The thickness of web will be in the neighbourhood of ½ inch. The overall length of the trough for a standard height barrier will be in the neighbourhood of 27 inches, while the I-beam flange may be less, for example, about 18 inches. The dimensions provided are, of course, examples only and apply to particular sizes of barriers. The dimensions are important primarily to ensure that the coupling members are rugged and not subject to easy damage during assembly and disassembly and provide sufficient play so that the barriers may be misaligned to enable the barriers to be placed around curves as required.

It should be understood that preferably the trough and the I-beam are fabricated from standard rolled products which will minimize not only the expense of manufacture, but also dangers and expenses involved in fabricating, for example, by welding flanges onto webs. The simplicity of the intercoupling members is such that they may conveniently be manufactured from standard rolled products simply by cutting off portions of the product. The only assembly required is the addition of the stirrups which are imbedded in the concrete and not subject to impact.

A barrier is formed by placing trough 5 at one end of a suitable form and holding it in place and similarly mounting I-beam section 13 at the other end of the form and holding it in place. Suitable rebars may then be connected, such as rebar 12, between the stirrups 6 and 17 to provide increased tensile strength to the barrier in a known manner. Concrete may then be poured into the form and permitted to harden after which the barrier may be removed from the form and cured in a desirable manner.

While certain dimensions have been suggested, the particular specifications for the various components, both the metal components and the concrete, will vary depending on the particular application, but their selection will be obvious to one skilled in the art.

I claim:

1. A roadway barrier element comprising a cast concrete body of substantially prismatic form having substantially flat upper, lower and end surfaces and locking means at each said end surface, said locking means at one of said end surfaces comprising a female member in the form of a metallic trough embedded in said concrete body extending from said upper surface to said lower surface and open at each end, said locking means at the other of said end surfaces comprising a male member of "T" shaped cross-section wherein the width of the crossbar of the "T" is "W", the height of the vertical leg of the "T" is "d" and the thickness of the vertical leg of the "T" is "t" formed from a section of steel I beam with one flange and a portion of the web embedded in the concrete body and the other flange protruding from the surface of said other end and extending from a point adjacent said upper surface to a point adjacent said lower surface wherein said trough has inwardly turned outer edges which lie substantially in the plane of said end surface and define a slot extending substantially from said lower surface to said upper surface, said trough having an internal width slightly greater than "w", said slot having a width slightly greater than "t", and said trough having an internal dimension from the slot to the inner surface of the trough slightly greater than "d".

2. A roadway barrier element as claimed in claim 1 wherein said female member comprises a section of rectangular cross-section steel tube with said slot cut through one side continuing from one end to the other of said section.

3. A roadway barrier element as claimed in claim 1 wherein the embedded portions of said locking means are attached to stirrup members.

4. A roadway barrier element as claimed in claim 3 wherein stirrup members of one locking means are connected to stirrup members of the other locking means by means of continuous steel rods extending longitudinally through said cast concrete body.

5. A roadway barrier element comprising an elongated cast concrete body having constant cross-section and flat upper, lower and end surfaces all perpendicular to the longitudinal axis of said body, a female locking member embedded in a first end of said body, said female locking member having a rectangular tubular cross-section and a slot in said female locking member located in the wall of said locking member and lying at said first end surface and extending from the lower surface to the upper surface of said body, a male locking member partially embedded in the second end, said male locking member comprising a section of "I" beam having two flanges and a joining web with one flange embedded in said body and said web extending through said second end surface and the other flange projecting beyond said second end surface, each locking member extending continuously from a point adjacent said lower surface to a point adjacent said upper surface of said body.

6. A roadway barrier element as claimed in claim 5 wherein the flange of said "I" beam has a width "w", the extension of the web from the outer surface of the flange to the point where the web enters the concrete body is "d", and the web has a thickness "t" and the trough has an internal dimension slightly greater than "w", and a dimension from the slot to the opposing wall of the female locking member slightly greater than "d", and the slot has a dimension slightly greater than "t".

7. A roadway barrier element as claimed in claim 6 wherein the edge of the flange of the "I" beam section is chamfered off at each end to produce two sloping surfaces almost meeting at the web.

* * * * *